US012256805B1

(12) United States Patent
Valle et al.

(10) Patent No.: US 12,256,805 B1
(45) Date of Patent: Mar. 25, 2025

(54) ORTHOTIC INSERT

(71) Applicant: Northwest Podiatric Laboratory, Inc., Blaine, WA (US)

(72) Inventors: Ruben Valle, Bellingham, WA (US); Dylan Rice, Seattle, WA (US); Timothy Messmer, Anacortes, WA (US); Benjamin Lange, Custer, WA (US); Matthew Hill, Blaine, WA (US); Lucas Wyatt, Lynden, WA (US)

(73) Assignee: Northwest Podiatric Laboratory, Inc., Blaine, WA (US)

( * ) Notice: Subject to any disclaimer, the term of this patent is extended or adjusted under 35 U.S.C. 154(b) by 0 days.

(21) Appl. No.: 18/781,705

(22) Filed: Jul. 23, 2024

(51) Int. Cl.
*A43B 7/14* (2022.01)
*A43B 7/1405* (2022.01)
*A43B 7/142* (2022.01)
*A43B 7/144* (2022.01)

(52) U.S. Cl.
CPC ..... *A43B 7/142* (2013.01); *A43B 7/141* (2013.01); *A43B 7/144* (2013.01)

(58) Field of Classification Search
CPC ..... A43B 7/142; A43B 7/144; A43B 7/141; A43B 7/14; A43B 7/1415
USPC ..... 36/44
See application file for complete search history.

(56) References Cited

U.S. PATENT DOCUMENTS 2,213,770 A * 9/1940 Sajdak ..... A43B 7/1445 36/147
2,631,387 A * 3/1953 Shaw ..... A43B 7/14 36/43
4,232,457 A * 11/1980 Mosher ..... A43B 7/22 36/173
4,619,056 A * 10/1986 Lin ..... A43B 17/02 36/43
4,718,179 A * 1/1988 Brown ..... A43B 7/144 36/173
4,803,747 A * 2/1989 Brown ..... A43B 7/142 36/154
4,962,593 A * 10/1990 Brown ..... A43B 7/142 36/173
5,373,650 A * 12/1994 Dananberg ..... A43B 7/14 36/43
5,722,186 A * 3/1998 Brown ..... A43B 1/0054 36/43
5,842,294 A * 12/1998 Fabricant ..... A43B 7/142 36/173
6,098,319 A * 8/2000 Epstein ..... A61F 5/14 36/43
6,125,557 A * 10/2000 Brown ..... A43B 7/14 36/144

(Continued)

*Primary Examiner* — Marie D Bays
(74) *Attorney, Agent, or Firm* — Seed IP Law Group LLP

(57) ABSTRACT

An orthotic insert for use within footwear, may include a support shell. The support shell may include a forward portion configured to underlie and support a plantar surface of a metatarsal head area of a foot of a user and a rear portion configured to underlie and support a plantar surface of a heel of the foot of the user. The rear portion may include a heel post to provide frontal plane stabilization to the foot of the user during use. The heel post may define a perimeter structure having a hexagonal or other geometric shape that extends in a downward direction from a bottom surface of the support shell and terminates in a substantially planar footwear engagement surface.

29 Claims, 8 Drawing Sheets

(56) References Cited

U.S. PATENT DOCUMENTS 6,315,786 B1 * 11/2001 Smuckler ..... A43B 7/144 36/145
6,408,543 B1 * 6/2002 Erickson ..... A43B 7/144 36/28
6,604,301 B1 * 8/2003 Manoli, II ..... A43B 7/223 36/43
6,681,501 B1 * 1/2004 Polifroni ..... A43B 7/28 36/43
7,913,429 B1 * 3/2011 Wert ..... A43B 7/144 36/44
9,179,736 B2 * 11/2015 Segel ..... A43B 17/02
2004/0103561 A1 * 6/2004 Campbell ..... A43B 23/17 36/155
2004/0123498 A1 * 7/2004 Lietzman ..... A43B 1/0009 36/145
2006/0123663 A1 * 6/2006 Swensen ..... A43B 7/142 36/43
2010/0218398 A1 * 9/2010 Reinhardt ..... A43B 7/223 36/44
2011/0192051 A1 * 8/2011 Wadman ..... A43B 3/0042 12/142 N
2012/0304490 A1 * 12/2012 Pichler ..... A43B 17/14 36/43
2014/0109439 A1 * 4/2014 Barr ..... A43B 7/144 36/43
2014/0366399 A1 * 12/2014 Wakeland ..... A43B 13/386 36/44
2015/0342295 A1 * 12/2015 Moon ..... A43B 7/146 36/43
2016/0219970 A1 * 8/2016 Jacob ..... A43B 17/02
2017/0006961 A1 * 1/2017 Pedersen ..... A43B 7/143
2019/0313735 A1 * 10/2019 Weiss ..... A43B 17/14
2020/0359736 A1 * 11/2020 Hilario ..... A43B 7/28
2022/0264991 A1 * 8/2022 Epstein ..... A43B 7/14
2022/0378152 A1 * 12/2022 Chen ..... A43B 17/14

* cited by examiner

ORTHOTIC INSERT

BACKGROUND

Technical Field

The present disclosure relates to orthotic inserts to be used within footwear.

Description of the Related Art

Orthotic inserts may be used by individuals to improve gait issues and/or to decrease foot pain while walking or running. Generally, orthotic inserts position parts of the user's foot and control various movements of the user's foot, such as those which occur on a sagittal plane of the foot and a frontal plane of the foot.

Prior orthotic inserts may not provide appropriate stiffness to various portions of the foot and/or may not provide adequate support to the foot. Other orthotic insert examples may be specifically tailored to a single anatomical foot structure, causing a large variety of orthotic insert designs to be necessary to provide orthotic inserts for the needs of a broad range of individuals. Further, prior orthotic inserts may limit motion control of a user of the orthotic insert.

BRIEF SUMMARY

The present disclosure is generally directed to orthotic inserts to be used within footwear. The orthotic inserts described herein may provide increased customization of sagittal plane flexibility, increased frontal plane stabilization, and increased motion control to a user of the orthotic insert. Further, the orthotic inserts described herein may provide variable shock absorption and may limit unwanted sliding of the orthotic insert within footwear.

An orthotic insert for use within footwear may include a support shell having one or more features that are particularly well adapted to enhance support of a user's foot while providing sufficient flexibility to facilitate natural foot movement. The support shell may include a forward portion configured to underlie and support a plantar surface of a metatarsal head area of a foot of a user and a rear portion configured to underlie and support a plantar surface of a heel of the foot of the user. The rear portion may include a heel post configured to provide frontal plane stabilization to the foot of the user during use. The heel post may define a perimeter structure having a hexagonal or other geometric shape that extends in a downward direction from a bottom surface of the support shell and may terminate in a substantially planar footwear engagement surface.

A thickness of the heel post extending from the bottom surface of the support shell may vary throughout the heel post. A center point of the heel post may be aligned with a center of a contact point of the heel of the user with the orthotic insert. A center point of the heel post may be offset from a trailing end of the support shell along a longitudinal length of the support shell by at least 14%, at least 16% or at least 18% of an overall longitudinal length of the support shell. The support shell may define a heel cup supported by the heel post. The heel cup may include a heel cup depth that is greater than 6%, greater than 8%, or greater than 10% of an overall longitudinal length of the support shell. The heel cup may include a heel cup width that is greater than 34%, greater than 36%, or greater than 38% of an overall longitudinal length of the support shell. A forward portion of the heel post may taper to be flush with the bottom surface of the support shell. The heel post may include a center portion, and at least a section of the center portion may not extend downward from the bottom surface of the support shell. A support shell of the orthotic insert may further include an arch-support portion between the rear portion and the forward portion. The heel post may be positioned entirely within the rear portion aft of the arch-support portion of the support shell.

The support shell of the orthotic insert may further include at least one rib extending downward from the rear portion of the support shell to the forward portion of the support shell. The at least one rib may extend downward from the bottom surface of the support shell. The at least one rib of the orthotic insert may include a first rib positioned on a medial side of the support shell and a second rib positioned on a lateral side of the support shell. The first and second ribs may be connected together via a bridge portion. The bridge portion may intersect or overlap with the heel post. The bridge portion and aft ends of the first and second ribs may define a partial hexagonal shape that intersects with the heel post. The first and second ribs may each have a generally planar lower surface to engage the footwear in use. The first and second ribs may ramp toward the bottom surface and forward portion of the support shell. The first and second ribs may extend in a longitudinal direction and may be substantially aligned with opposing outer sides of the heel post. At least a first rib of the at least one rib may intersect and/or merge with the heel post. A thickness of the at least one rib extending from the bottom surface of the support shell may vary along a longitudinal length of the at least one rib. The thickness of the at least one rib may taper to be flush with the bottom surface within the forward portion of the support shell.

The support shell may comprise a rigid material with enhanced strength characteristics, such as, for example, glass-reinforced polypropylene.

A shell thickness between an upper surface of the support shell and the bottom surface of the support shell may be equal to or less than 2 mm to provide a particularly low profile shell that is able to be positioned within the foot cavity of footwear without substantially reducing the occupiable space of the foot cavity.

In some instances, the orthotic insert may further include a cover configured to overlay the support shell. The cover may include a lower surface and an upper surface. At least a portion of the lower surface of the cover may be coupled to an upper surface of the support shell, such as, via adhesive or the like. The upper surface of the cover may face upward to receive the foot of the user. At least one region of a forefoot area of the cover may include an extension pattern extending downward from the lower surface of the cover. The extension pattern may include a honeycomb pattern. The extension pattern may be offset from the lower surface of the cover to enhance engagement of the orthotic insert with the footwear and provide variable shock absorption when the orthotic insert is in use. A thickness of the cover may vary over the at least one region due to thickness differences in the extension pattern. The extension pattern may define multiple alternative flex line paths across a width of the cover to enable the cover to flex in a plurality of different ways to accommodate differences among anatomical features of different users.

A collection of orthotic inserts as described herein may include a first orthotic insert, a second orthotic insert and a third orthotic insert, each having a different heel post height to provide a different degree of frontal plane stabilization. For example, the heel posts of the first, second and third orthotic insert may include relatively tall posts to provide more frontal plane stabilization, relatively short posts to provide less frontal plane stabilization, or a heel post height therebetween for moderate frontal plane stabilization.

A collection of orthotic inserts as described herein may include a first orthotic insert, a second orthotic insert and a third orthotic insert, each having longitudinal extending ribs of different thickness profiles to provide a different degree of stiffness and foot motion control. For example, the longitudinal extending ribs of the first, second and third orthotic insert may include relatively thin ribs to provide enhanced flexibility, relatively thick ribs to provide enhanced stiffness, or a thickness therebetween for moderate flexibility.

A collection of orthotic inserts as described herein may include a first orthotic insert, a second orthotic insert and a third orthotic insert each having a support shell with a different upper surface profile, but having a common heel post height and longitudinal extending ribs with a same thickness profile. The upper surface profile may include, for example, arch support heights that vary between the first, second and third orthotic insert support to provide mild arch support, moderate arch support, and high arch support.

DETAILED DESCRIPTION

In the following description, certain specific details are set forth in order to provide a thorough understanding of various disclosed embodiments. However, one skilled in the relevant art will recognize that embodiments may be practiced without one or more of these specific details. In other instances, well-known structures and manufacturing techniques associated with orthotic inserts may not be shown or described in detail to avoid unnecessarily obscuring descriptions of the embodiments.

Figure 1A:
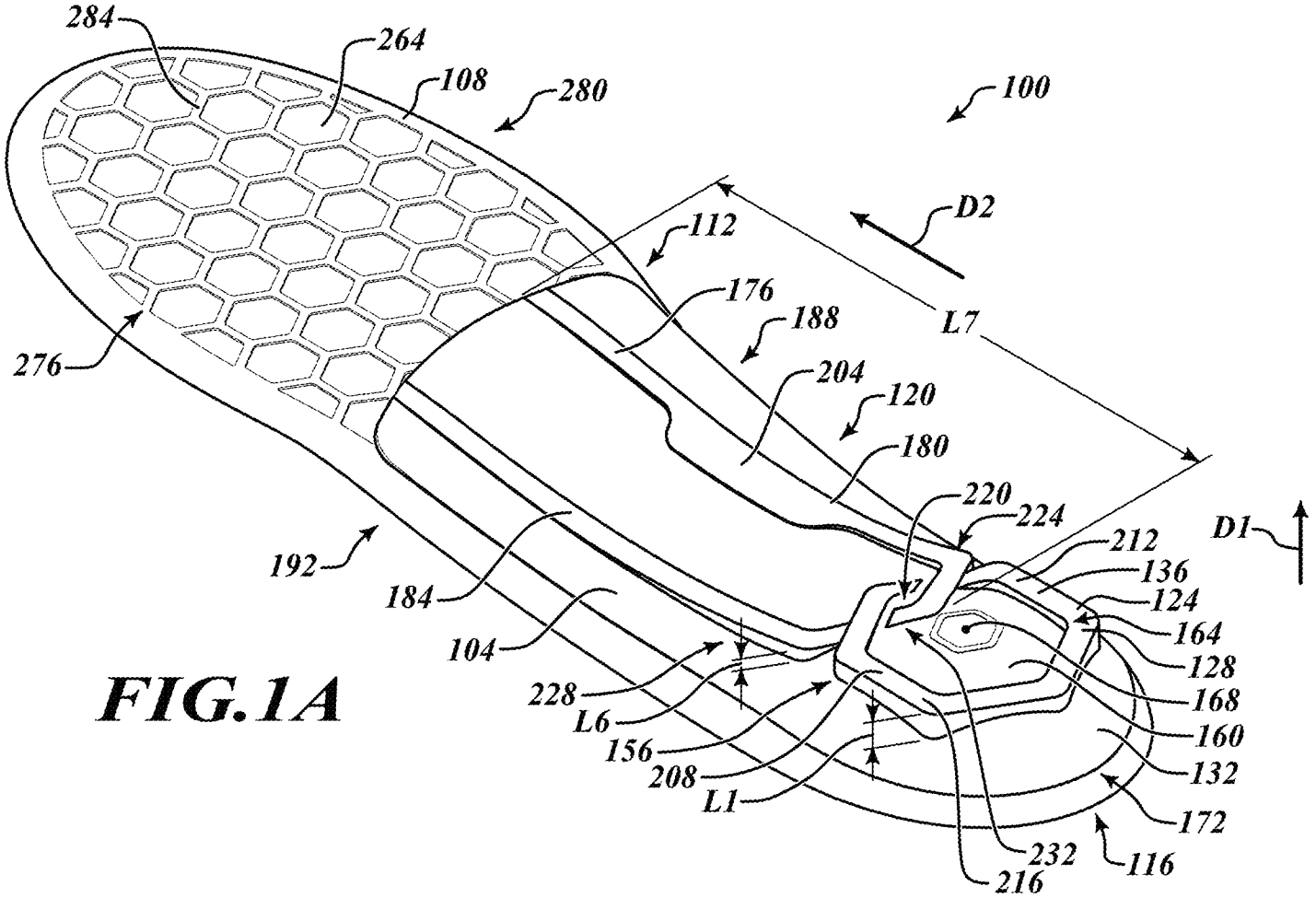
FIG. 1A shows a bottom perspective view of an orthotic insert according to an embodiment of the present disclosure.

FIG. 1A shows a bottom perspective view of an orthotic insert 100. The orthotic insert 100 may include a support shell 104. In some embodiments, the orthotic insert 100 may further include a top cover 108 configured to overlay the support shell 104.

The support shell 104 may include a forward portion 112 and a rear portion 116. The forward portion 112 may be configured to underlie and support a plantar surface of a metatarsal head area of a foot of a user. The rear portion 116 may be configured to underlie and support a plantar surface of a heel of the foot of the user. The support shell may further include an arch-support portion 120 positioned between the forward portion 112 and the rear portion 116.

The rear portion may include a heel post 124 extending in a downward direction D1 and configured to provide frontal plane stabilization to the foot of the user during use. The frontal plane stabilization may be realized by limiting excessive pronation and/or supination during a gait cycle. The heel post 124 may be positioned entirely within the rear portion 116 of the support shell 104. In other words, the heel post 124 may be positioned aft of the arch-support portion 120 of the support shell 104. The heel post 124 may define a perimeter structure 128 having a hexagonal or other regular geometric shape (e.g., circular, rectangular, octagonal) that extends in a downward direction D1 from a bottom surface 132 of the support shell 104. In other instances, the perimeter structure 128 may have an irregular shape and follow an irregular path. The heel post 124 may include a substantially planar footwear engagement surface 136, at which the heel post 124 terminates.

Figure 1B:
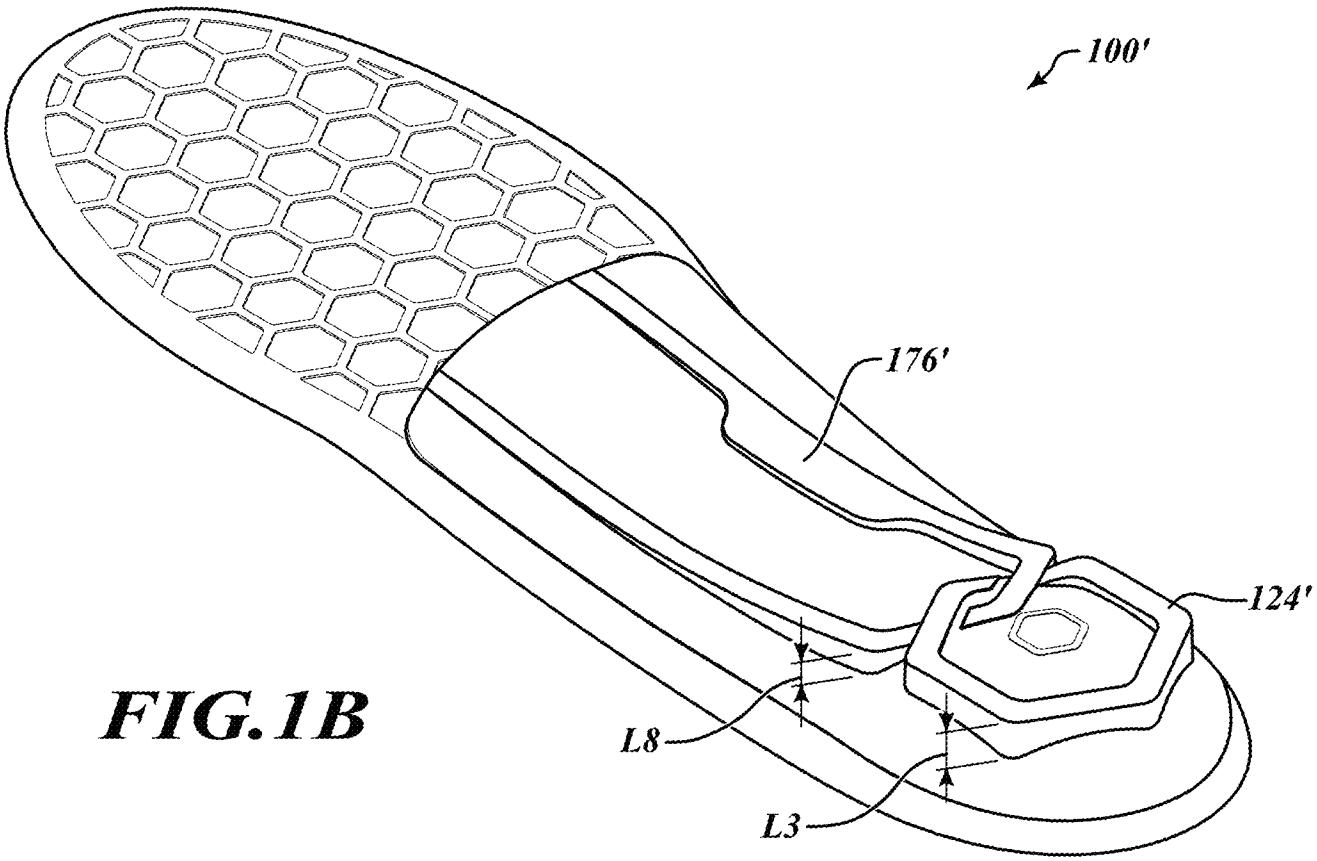
FIG. 1B shows a bottom perspective view of a second orthotic insert according to another embodiment of the present disclosure.
Figure 1C:
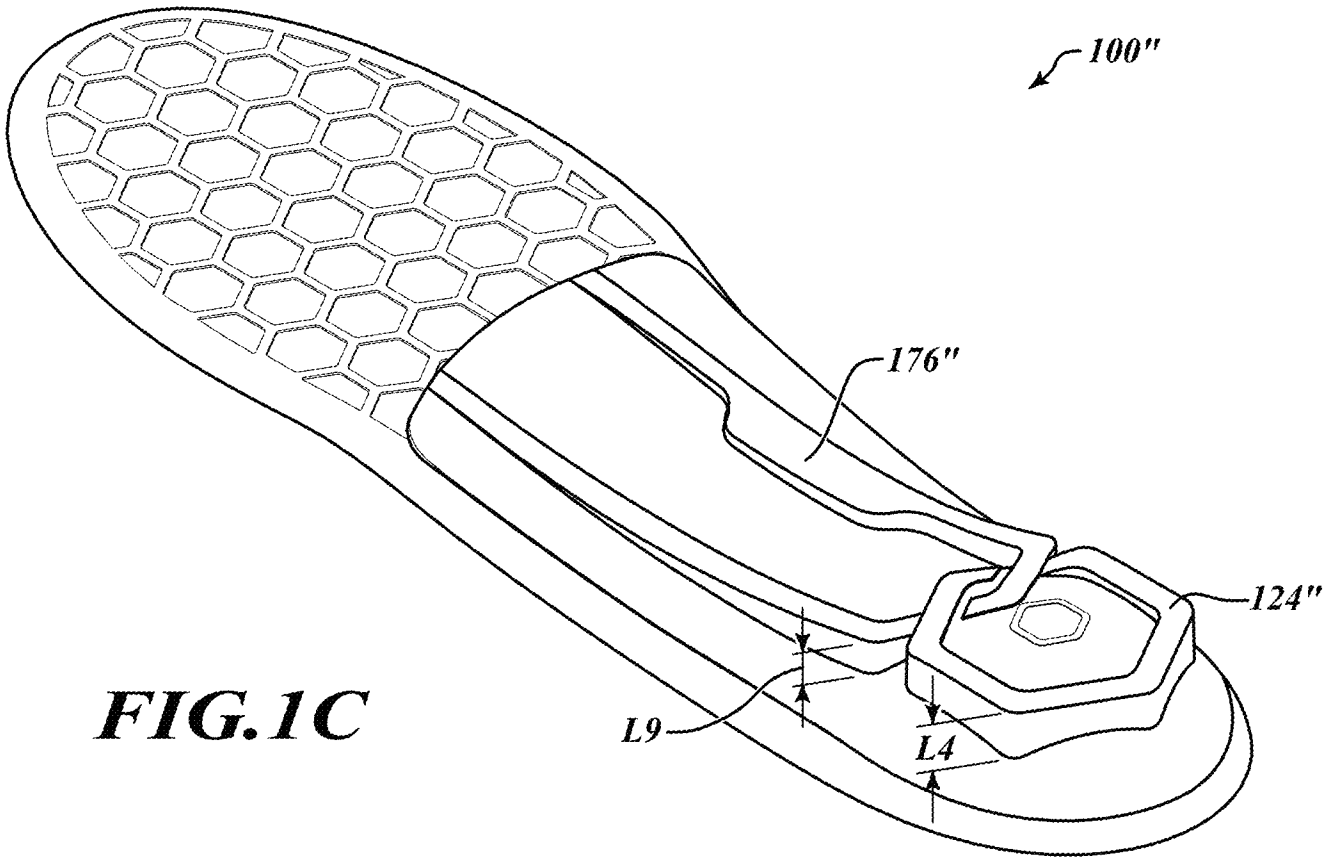
FIG. 1C shows a bottom perspective view of a third orthotic insert according to another embodiment of the present disclosure.
Figure 2A:
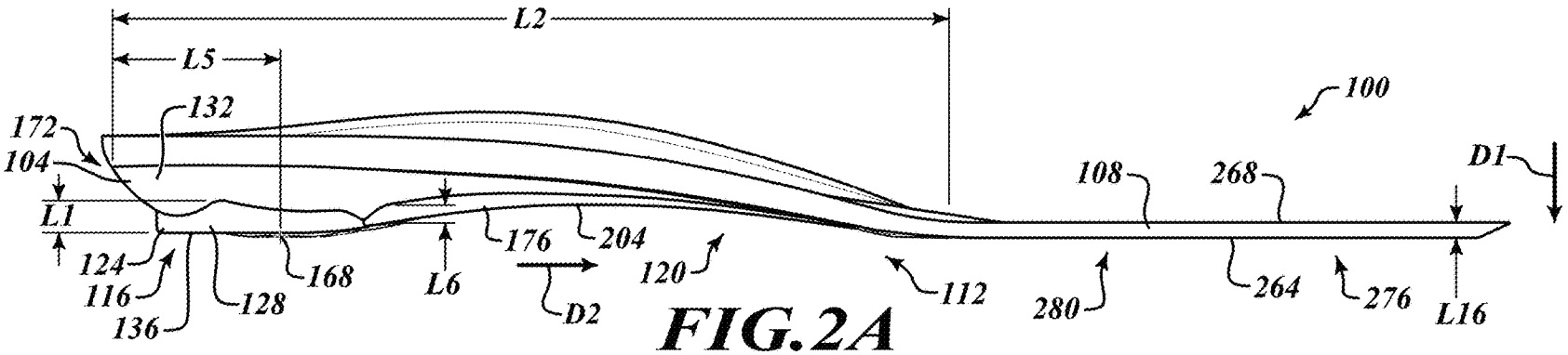
FIG. 2A shows a side plan view of the orthotic insert of FIG. 1A.
Figure 2B:
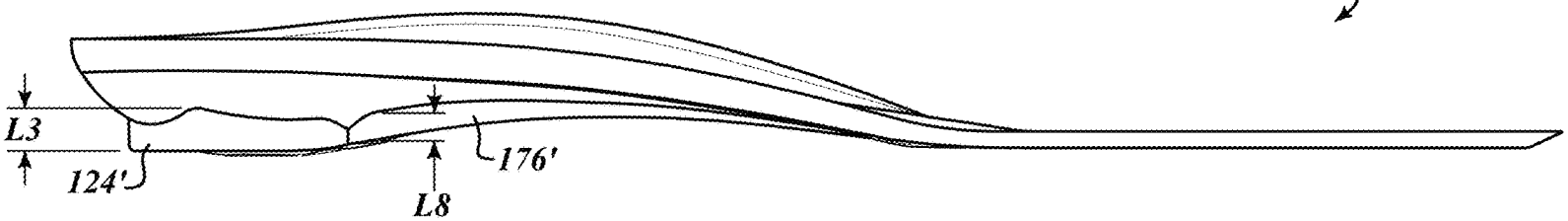
FIG. 2B shows a side plan view of the second orthotic insert of FIG. 1B.
Figure 2C:
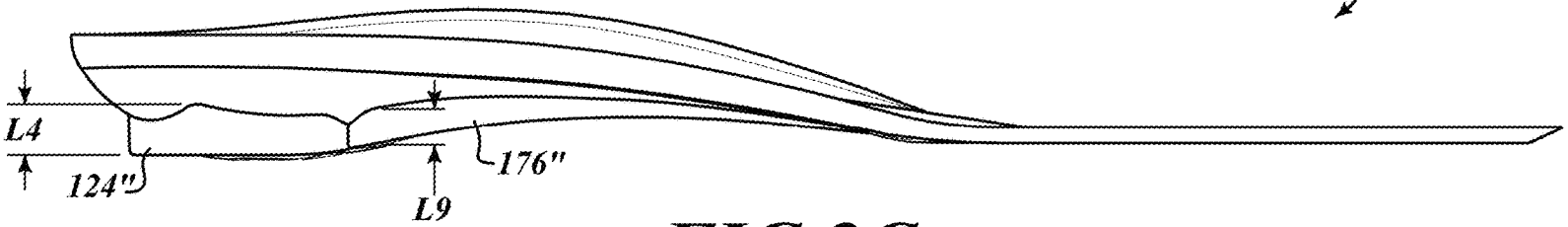
FIG. 2C shows a side plan view of the third orthotic insert of FIG. 1C.

A thickness L1 of the heel post 124 (i.e., a distance the heel post 124 extends from the bottom surface 132 of the support shell 104) may vary throughout the heel post 124, as shown in FIG. 2A. The thickness L1 of the heel post 124 may differ from a thickness of a heel post on other orthotic inserts, even in situations in which a value of other dimensions of the support shell 104 remain static among a collection of orthotic inserts, such as a collection of orthotic inserts having a common overall longitudinal length L2 of the support shell 104. For example, the orthotic insert 100 shown in FIGS. 1A and 2A includes the thickness L1 of the heel post 124, another orthotic insert 100' shown in FIGS. 1B and 2B includes thickness L3 of heel post 124', and yet another orthotic insert 100" shown in FIGS. 1C and 2C includes thickness L4 of heel post 124". Each orthotic insert of the orthotic inserts 100, 100', 100" includes different thicknesses L1, L3, L4 of the respective heel post 124, 124', 124", despite the longitudinal length L2 of the support shell 104 of the orthotic inserts 100, 100', 100" being about the same, the same or identical. Varying thickness of heel posts 124, 124', 124" may provide different degrees of frontal plane stabilization to the user, depending on the needs of the individual user. For example, the heel posts of the orthotic inserts may include relatively tall posts to provide more frontal plane stabilization, relatively short posts to provide less frontal plane stabilization, or a heel post height therebetween for moderate frontal plane stabilization.

With reference back to FIGS. 1A and 2A, a forward portion 156 of the heel post 124 may taper to be flush with the bottom surface 132 of the support shell 104. At least an area 160 of a center region 164 defined by the heel post 124 may be devoid of structure extending downward from the bottom surface 132 of the support shell 104. A center point 168 of the heel post 124 may be aligned or substantially aligned with a center of a contact point of the heel of the user with the orthotic insert 100. The center point 168 of the heel post 124 may be offset from a trailing end 172 of the support shell 104 by a longitudinal length L5. The longitudinal length L5 to the center point 168 of the heel post 124 may be at least 14%, at least 16% or at least 18% of the overall longitudinal length L2 of the support shell 104. Embodiments including a relatively longer longitudinal length L5 may provide more functional control over the user's foot compared to prior orthotic inserts.

With continued reference to FIGS. 1A and 2A, the support shell 104 may also include at least one rib 176 extending in a longitudinal direction D2 from the rear portion 116 of the support shell 104 to the forward portion 112 of the support shell 104. The at least one rib 176 may extend downward from the bottom surface 132 of the support shell 104. In some embodiments, the at least one rib 176 may include a first rib 180 and a second rib 184. The first rib 180 may be positioned on a medial side 188 of the support shell 104. The second rib may be positioned on a lateral side 192 of the support shell 104. The at least one rib 176 may provide additional stability to a user of the orthotic insert. The at least one rib 176 may, for example, add stiffness to a medial arch section of the orthotic insert 100 and may provide motion control to the user. The first and second ribs 180, 184 may be extend generally parallel to each other along the bottom surface 132 of the support shell 104.

In some embodiments, a thickness L6 of the at least one rib 176 extending from the bottom surface 132 of the support shell 104 may vary along a longitudinal length L7 of the at least one rib 176, as shown in FIGS. 1A and 2A. In some embodiments, the thickness L6 of the at least one rib 176 may taper, such that the thickness L6 of the at least one rib 176 decreases toward the forward portion 112 of the support shell 104. In some embodiments, the thickness L6 of the first rib 180 and the second rib 184 may differ to provide varying levels of stiffness on opposing sides of the support shell 104. In some embodiments, the thickness L6 of the first rib 180 and the second rib 184 be the same to provide a more balanced stiffness profile across the width of the support shell 104. In some embodiments, the thickness L6 of the at least one rib 176 may be flush or substantially flush with the bottom surface 132 within the forward portion 112 of the support shell 104. In some embodiments, the first rib 180 and the second rib 184 may taper at different slopes. In some embodiments, the first rib 180 and the second rib 184 may taper at about the same, the same or identical slopes.

The thickness L6 of the at least one rib 176 may differ from a thickness of at least one rib on other orthotic inserts, even in situations in which a value of other dimensions of the support shell 104 of a collection of orthotic inserts remain static, such as, for example, an overall longitudinal length L2 of the support shell 104 of the collection of orthotic inserts. For example, the orthotic insert 100 shown in FIGS. 1A and 2A includes the thickness L6 of the at least one rib 176, the second orthotic insert 100' shown in FIGS. 1B and 2B includes thickness L8 of at least one rib 176', and the third orthotic insert 100" shown in FIGS. 1C and 2C includes thickness L9 of at least one rib 176". Each orthotic insert of the orthotic inserts 100, 100', 100" includes different thicknesses L6, L8, L9 of the respective at least one ribs 176, 176', 176", despite the longitudinal length L2 of the support shell 104 of the orthotic inserts 100, 100', 100" being identical. Varying thickness of ribs 176, 176', 176" may provide different degrees of stiffness and foot motion control to the user, depending on the needs of the individual user. For example, the longitudinal extending ribs of the orthotic inserts may include relatively thin ribs to provide enhanced flexibility, relatively thick ribs to provide enhanced stiffness, or may have a thickness therebetween for moderate flexibility.

The at least one rib 176 may include a generally planar lower surface 204. The generally planar lower surface 204 of the at least one rib 176 may be configured to engage the footwear when in use and, more particularly, the internal footbed of the footwear.

With reference to the bottom plan view of the orthotic insert 100 shown in FIG. 4, the at least one rib 176 may be substantially aligned with an outer side 208 of the heel post 124. In some embodiments, the first rib 180 may be substantially aligned with a first outer side 212 of the heel post 124. In some embodiments, the second rib 184 may be substantially aligned with a second outer side 216 of the heel post 124. In some embodiments, the first rib 180 may be substantially aligned with the first outer side 212 of the heel post 124 and the second rib 184 may be substantially aligned with the second outer side 216 of the heel post 124. In some embodiments, at least one rib 176 may intersect the heel post 124 and/or the at least one rib 176 may merge with the heel post 124.

With continued reference to FIG. 4, the first rib 180 and the second rib 184 may be connected together via a bridge portion 220. In some embodiments, the bridge portion 220 may intersect the heel post 124. In some embodiments, the bridge portion 220 may overlap with the heel post 124. In some embodiments, the bridge portion 220 and aft ends 224, 228 of the first and second ribs 180, 184 may define a partial hexagonal or other geometric shape 232 that intersects with the heel post 124.

Figure 3:
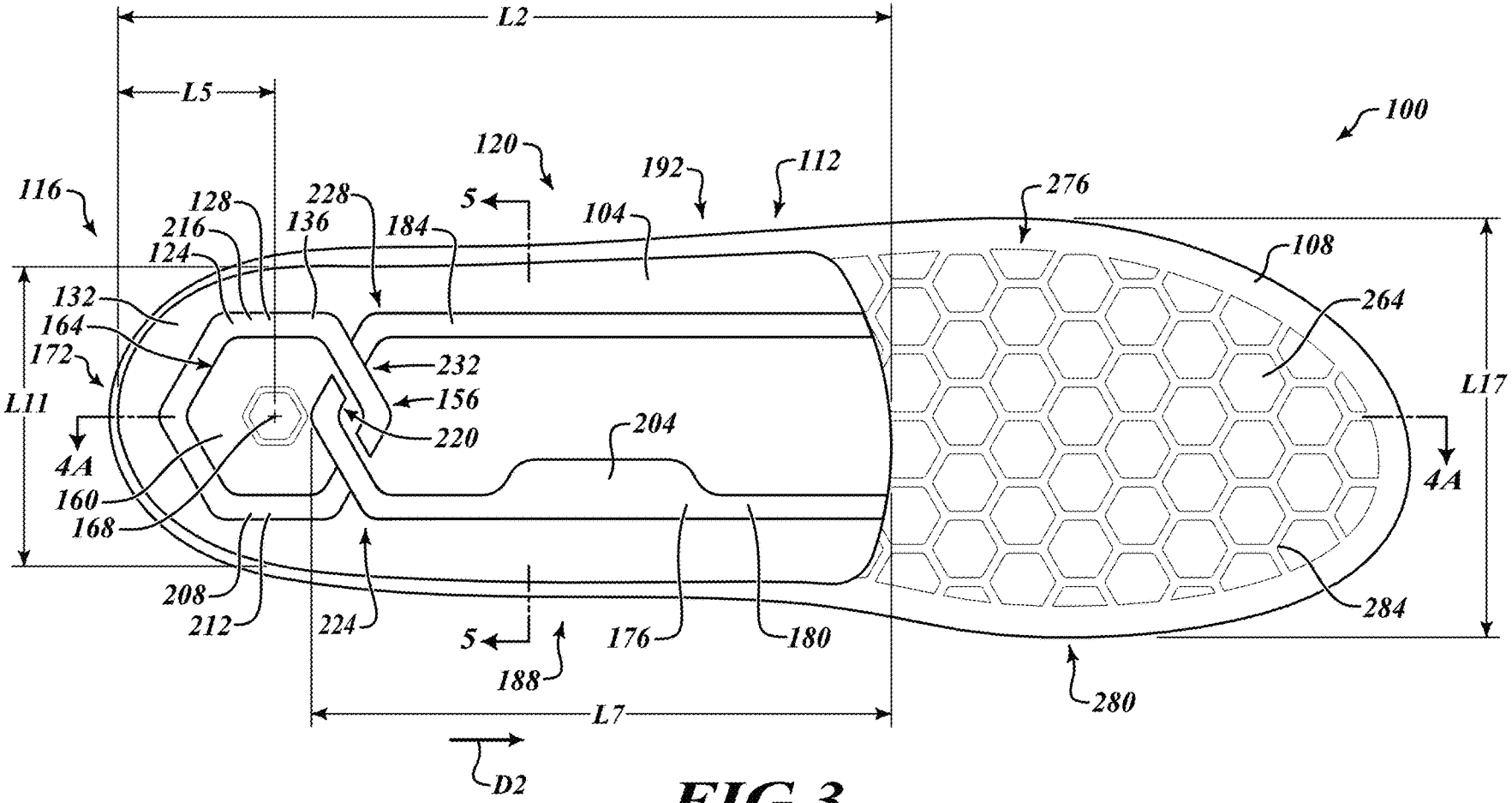
FIG. 3 shows a bottom view of the orthotic insert of FIG. 1A.
Figure 4A:
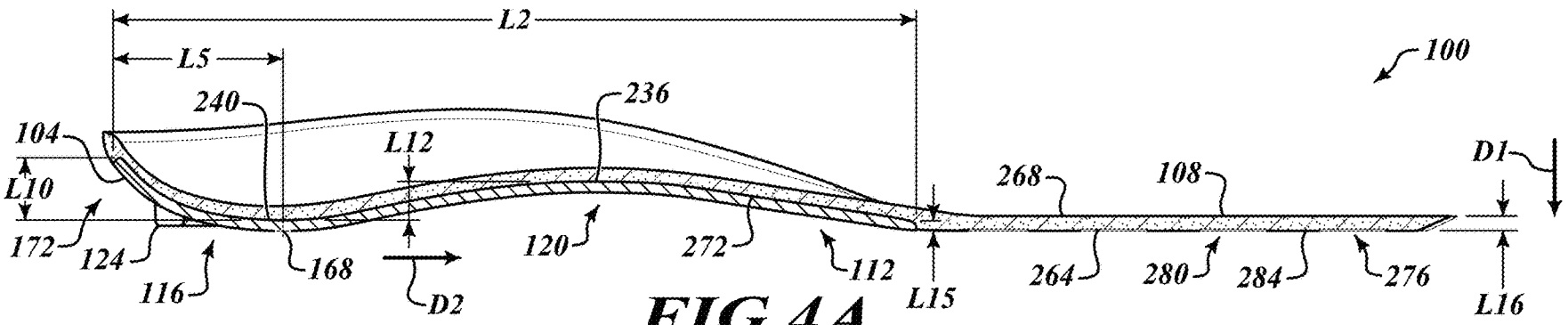
FIG. 4A shows a cross-sectional side view of orthotic insert of FIG. 1A taken from FIG. 3.
Figure 4B:
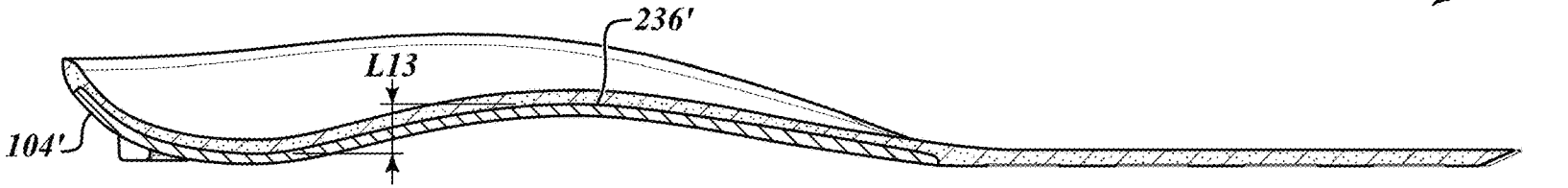
FIG. 4B shows a cross-sectional side view of another orthotic insert defining a different upper surface profile from the orthotic insert of FIG. 1A.
Figure 4C:
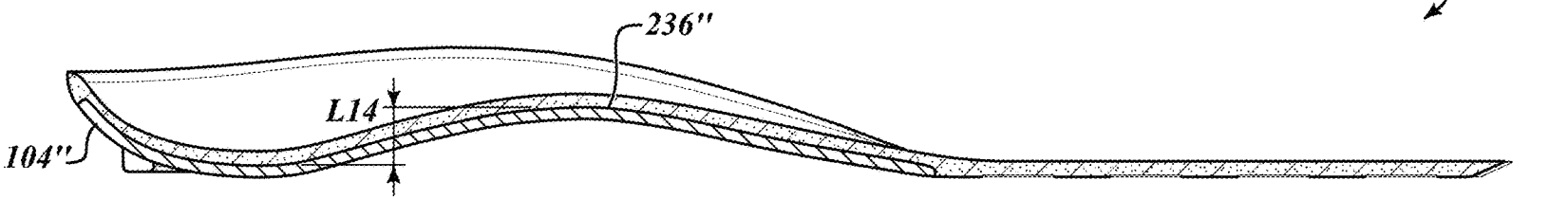
FIG. 4C shows a cross-sectional side view of another orthotic insert defining a different upper surface profile from the orthotic insert of FIG. 1A.

With reference to the cross-sectional view of the orthotic insert 100 shown in FIG. 4A, the support shell 104 may define an upper surface 236 including a heel cup 240 supported by the heel post 124. The heel cup 240 may include a heel cup depth L10 that is greater than 6%, greater than 8%, or greater than 10% of an overall longitudinal length L2 of the support shell 104. The heel cup 240 may include a heel cup width L11 (FIG. 3) that is greater than 34%, greater than 36%, or greater than 38% of an overall longitudinal length L2 of the support shell 104. The heel cup 240 may provide additional support to the user due to the larger dimensions (i.e., wider heel cup and deeper heel cup) than orthotic inserts provided in the prior art.

The upper surface 236 of the support shell 104 may differ from an upper surface of other support shells in a collection of orthotic inserts, even in situations in which a value of other dimensions of the support shell 104 of the collection of orthotic inserts remain static, such as, for example, a thickness of a heel post and/or a thickness of ribs remaining the same or substantially the same in the collection of orthotic inserts. For example, the orthotic insert 100 shown in FIG. 4A includes an upper surface 236 characterized in part by an arch height L12, while the orthotic insert 100" shown in FIG. 4B includes a support shell 104' with an upper surface 236' characterized in part by an arch height L13, and while the orthotic insert 100" shown in FIG. 4C includes upper surface 236" has a support shell 104" characterized in part by an arch height L14. Each support shell of the support shells 104, 104', 104" includes different upper surfaces 236, 236', 236", despite the thickness of the heel posts and the thickness of the ribs of the support shells 104, 104', 104" being about the same, the same or identical. Varying an upper surface 236, 236', 236" of the support shells 104, 104', 104", in particular the arch heights, may provide varying fits to users of the orthotic inserts and provide different levels of arch support while still retaining beneficial properties provided by other features of the orthotic inserts, such as the heel post and ribs of the support shells 104, 104', 104".

Figure 5:
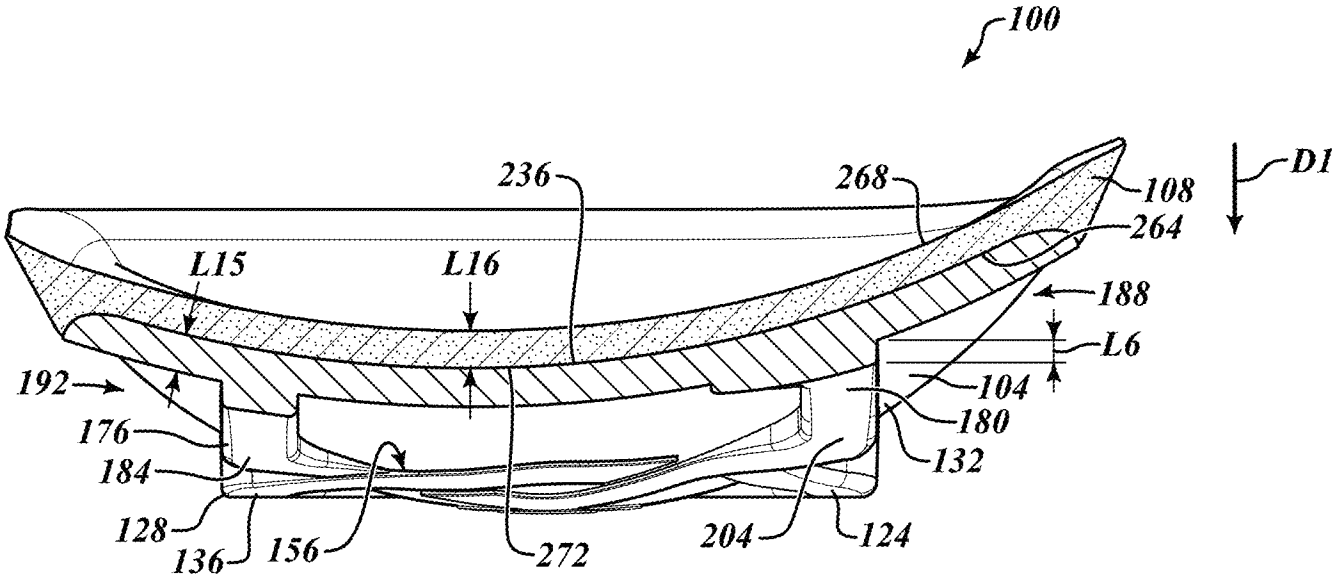
FIG. 5 shows a cross-sectional front view of the orthotic insert of FIG. 1A taken from FIG. 3.

With reference to FIG. 5, the support shell 104 may include a shell thickness L15 of equal to or less than 2 mm to provide a particularly low profile shell that is able to be positioned within the foot cavity of footwear without substantially reducing the occupiable space of the foot cavity. The shell thickness may be measured between the upper surface 236 of the support shell 104 and the bottom surface 132 of the support shell 104.

The support shell may comprise a rigid material with enhanced strength and other property characteristics, such as, for example, glass-reinforced polypropylene. Using such a material may aid in providing a support shell 104 with a particularly low profile and with enhanced durability and performance.

With reference to FIGS. 1A, 3, 4A, and 5, the orthotic insert 100 also may include the top cover 108 configured to overlay the support shell 104. The top cover 108 may include a lower surface 264 and an upper surface 268. At least a portion 272 of the lower surface 264 of the top cover 108 may be coupled to the upper surface 236 of the support shell 104, such as, via adhesive or the like. The upper surface 268 of the top cover 108 may face upward to receive the foot of the user thereon.

With reference to FIGS. 1A, 3 and 4A at least one region 276 of a forefoot area 280 of the top cover 108 may include an extension pattern 284 extending downward from the lower surface 264 of the top cover 108. The extension pattern 284 may be offset from the lower surface 264 of the top cover 108 to enhance engagement with the footwear and may provide variable shock absorption when the orthotic insert 100 is in use. Due to thickness differences in the extension pattern 284, a thickness L16 of the top cover 108 may vary over the at least one region 276, such as by alternating thicknesses of regions with and without structures of the extension pattern 284. In addition, the height of the extension pattern 284 may vary over a length and/or width of the orthotic insert to provide varying thickness.

Figure 6:
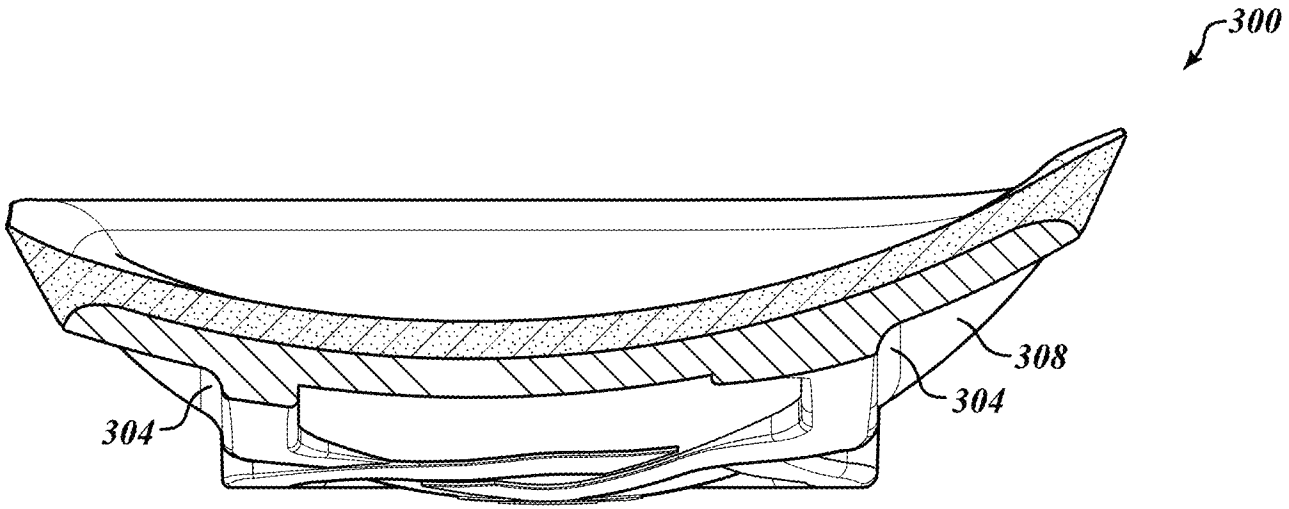
FIG. 6 shows a cross-sectional front view of an orthotic insert according to another embodiment of the disclosure.

It should be understood that edges of the support shell 104 may include fillets such that edges of the support shell 104 are curved and structures transition smoothly from one surface to another. FIG. 6 shows cross-sectional front view of an orthotic insert 300 according to an embodiment including fillets 304 of a support shell 308 of the orthotic insert 300. Such fillets are not limited to the any single feature of the support shell and may appear on one or more features thereof. For example, fillets may be present, for example, on at least one of the at least one rib and the heel post.

The extension pattern 284 may also define multiple alternative flex line paths across a width L17 of the top cover 108, which may enable the top cover 108 to flex in a plurality of different ways and to accommodate differences among anatomical features of users. For example, various users may have different foot types and/or shapes, such as different metatarsal parabola, different lengths of an arch, and different heights of an arch. The extension pattern 284 may enable individualized sagittal-plane flexibility for each of the various users without a need for separate orthotic inserts customized to each user.

In some embodiments, the extension pattern 284 may include a honeycomb pattern, or other pattern comprising repeated regular or irregular shapes.

In view of the above, it is appreciated that embodiments disclosed herein may provide orthotic inserts which may allow improved performance relative to traditional orthotic inserts. This is advantageous in providing improved orthotic inserts for users, particularly in terms of balancing support and flexibility. Other advantages and benefits will be appreciated by those of ordinary skill in the relevant art upon a detailed review of the disclosure.

The devices and systems of the disclosure each have several innovative aspects, no single one of which is solely responsible or required for the desirable attributes disclosed herein. The various features described above may be used independently of one another, or may be combined in various ways. All possible combinations and subcombinations are intended to fall within the scope of this disclosure. Various modifications to the implementations described in this disclosure may be readily apparent to those of ordinary skill in the art, and the generic principles defined herein may be applied to other implementations. Thus, the claims are not intended to be limited to the implementations shown herein, but are to be accorded the widest scope consistent with this disclosure, the principles and the novel features disclosed herein.

Certain features that may be described in this specification in the context of separate implementations also may be implemented in combination in a single implementation. Conversely, various features that may be described in the context of a single implementation also may be implemented in multiple implementations separately or in any suitable subcombination. Moreover, although features may be described above as acting in certain combinations and even initially claimed as such, one or more features from a claimed combination can be excised from the combination, and the claimed combination may be directed to a subcombination or variation of a subcombination. No single feature or group of features is necessary or indispensable to each and every embodiment.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. In addition, the articles "a," "an," and "the" as used in this application and the appended claims are to be construed to mean "one or more" or "at least one" unless specified otherwise.

In general, in the following claims, the terms used should not be construed to limit the claims to the specific embodiments disclosed in the specification and the claims, but should be construed to include all possible embodiments along with the full scope of equivalents to which such claims are entitled.

The invention claimed is:

1. An orthotic insert for use within footwear, the orthotic insert comprising a support shell including:

a forward portion configured to underlie and support a plantar surface of a metatarsal head area of a foot of a user; and a rear portion configured to underlie and support a plantar surface of a heel of the foot of the user, the rear portion including a heel post to provide frontal plane stabilization to the foot of the user during use, the heel post defining a perimeter wall structure having a hexagonal or other geometric shape that extends in a downward direction from a bottom surface of the support shell and terminates in a substantially planar footwear engagement surface, the perimeter wall structure being offset from sides of the rear portion of the support shell and encircling a center of a heel cup defined in part by the bottom surface of the support shell.

2. The orthotic insert of claim 1, wherein a thickness of the heel post extending from the bottom surface of the support shell varies throughout the heel post.

3. The orthotic insert of claim 1, wherein a center point of the heel post is configured to receive a center of a contact point of the heel of the user with the orthotic insert.

4. The orthotic insert of claim 1, wherein the center point of the heel post is offset from a trailing end of the support shell along a longitudinal length of the support shell by at least 14% of an overall longitudinal length of the support shell.

5. The orthotic insert of claim 1, wherein the heel cup is supported by the heel post, and wherein the heel cup includes a heel cup depth that is greater than 6% of an overall longitudinal length of the support shell.

6. The orthotic insert of claim 1, wherein the heel cup is supported by the heel post, and wherein the heel cup includes a heel cup width that is greater than 34% of an overall longitudinal length of the support shell.

7. The orthotic insert of claim 1, wherein a forward portion of the heel post tapers to be flush with the bottom surface of the support shell.

8. The orthotic insert of claim 7, wherein the heel post includes a center portion, and wherein at least a section of the center portion does not extend downward from the bottom surface of the support shell.

9. The orthotic insert of claim 1, wherein the support shell of the orthotic insert further includes an arch-support portion between the rear portion and the forward portion, and the heel post is positioned entirely within the rear portion aft of the arch-support portion of the support shell.

10. The orthotic insert of claim 1, wherein the support shell of the orthotic insert further includes at least one rib extending from the rear portion of the support shell to the forward portion of the support shell, the at least one rib extending downward from the bottom surface of the support shell.

11. The orthotic insert of claim 10, wherein the at least one rib of the orthotic insert includes a first rib positioned on a medial side of the support shell and a second rib positioned on a lateral side of the support shell.

12. The orthotic insert of claim 11, wherein the first and second ribs are connected together via a bridge portion, and wherein the bridge portion intersects or overlaps with the heel post.

13. The orthotic insert of claim 12, wherein the bridge portion and aft ends of the first and second ribs define a partial hexagonal shape that intersects with the heel post.

14. The orthotic insert of claim 11, wherein the first and second ribs each have a generally planar lower surface to engage the footwear in use, and wherein the first and second ribs ramp toward the bottom surface and the forward portion of the support shell.

15. The orthotic insert of claim 11, wherein the first and second ribs extend in a longitudinal direction and are substantially aligned with opposing outer sides of the heel post.

16. The orthotic insert of claim 10, wherein at least a first rib of the at least one rib intersects and/or merges with the heel post.

17. The orthotic insert of claim 10, wherein a thickness of the at least one rib extending from the bottom surface of the support shell varies along a longitudinal length of the at least one rib.

18. The orthotic insert of claim 17, wherein the thickness of the at least one rib tapers to be flush with the bottom surface within the forward portion of the support shell.

19. The orthotic insert of claim 1, wherein the support shell comprises glass-reinforced polypropylene.

20. The orthotic insert of claim 1, wherein a shell thickness between an upper surface of the support shell and the bottom surface of the support shell is equal to or less than 2 mm.

21. The orthotic insert of claim 1, further comprising a cover configured to overlay the support shell, the cover including a lower surface and an upper surface, at least a portion of the lower surface of the cover coupled to an upper surface of the support shell, and the upper surface of the cover facing upward to receive the foot of the user.

22. The orthotic insert of claim 21, wherein at least one region of a forefoot area of the cover comprises an extension pattern extending downward from the lower surface of the cover.

23. The orthotic insert of claim 22, wherein the extension pattern comprises a honeycomb pattern.

24. The orthotic insert of claim 22, wherein the extension pattern is offset from the lower surface of the cover to enhance engagement with the footwear and provide variable shock absorption when the orthotic insert is in use.

25. The orthotic insert of claim 22, wherein a thickness of the cover varies over the at least one region due to thickness differences in the extension pattern.

26. The orthotic insert of claim 22, wherein the extension pattern defines multiple alternative flex line paths across a width of the cover to enable the cover to flex in a plurality of different ways to accommodate differences among anatomical features of users.

27. A collection of orthotic inserts according to claim 1, and comprising a first orthotic insert, a second orthotic insert and a third orthotic insert each having a different heel post height to provide a different degree of frontal plane stabilization.

28. A collection of orthotic inserts according to claim 1, and comprising a first orthotic insert, a second orthotic insert and a third orthotic insert each having longitudinal extending ribs of different thickness profiles to provide a different degree of stiffness and foot motion control.

29. A collection of orthotic inserts according to claim 1, and comprising a first orthotic insert, a second orthotic insert and a third orthotic insert each having a support shell with a different arch height but having a common heel post height and longitudinal extending ribs with a same thickness profile.

* * * * *